US007983393B2

(12) United States Patent
Bermuth et al.

(10) Patent No.: US 7,983,393 B2
(45) **Date of Patent: *Jul. 19, 2011**

(54) CIRCULAR ACCELERATOR WITH ADJUSTABLE ELECTRON FINAL ENERGY

(75) Inventors: Joerg Bermuth, Mainz (DE); Georg Geus, Wiesbaden (DE); Gregor Hess, Wiesbaden (DE); Urs Viehboeck, Darmstadt (DE)

(73) Assignee: Smiths Heimann GmbH, Wiesbaden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/473,839

(22) Filed: May 28, 2009

(65) Prior Publication Data

US 2009/0290684 A1 Nov. 26, 2009

Related U.S. Application Data

(63) Continuation of application No. PCT/EP2007/007767, filed on Sep. 6, 2007.

(30) Foreign Application Priority Data

Nov. 28, 2006 (DE) ..... 10 2006 056 018

(51) Int. Cl.
*H01J 35/14* (2006.01)
*H01J 35/00* (2006.01)
*H05H 7/10* (2006.01)

(52) U.S. Cl. ..... 378/121; 378/138; 315/504; 315/507

(58) Field of Classification Search ..... 378/4–20, 378/119, 121, 138; 315/500, 501, 504, 507
See application file for complete search history.

(56) References Cited

U.S. PATENT DOCUMENTS

| | | | | |
|---|---|---|---|---|
| 2,572,414 | A * | 10/1951 | Wideroe | 315/504 |
| 5,122,662 | A * | 6/1992 | Chen et al. | 250/269.3 |
| 5,319,314 | A | 6/1994 | Chen | |
| 6,028,760 | A * | 2/2000 | Ferreira | 361/190 |
| 6,201,851 | B1 * | 3/2001 | Piestrup et al. | 378/121 |
| 7,259,529 | B2 * | 8/2007 | Tanaka | 315/501 |
| 2004/0017888 | A1 * | 1/2004 | Seppi et al. | 378/57 |

FOREIGN PATENT DOCUMENTS

| | | |
|---|---|---|
| EP | 0 412 190 A1 | 2/1991 |
| EP | 0 481 864 A1 | 4/1992 |

OTHER PUBLICATIONS

Rose M F: "High energy density capacitors for space power conditioning", IEEE Aerospace and Electronics Systems Magazine, USA, vol. 4, No. 11, Nov. 1989, pp. 17-22 XP002460113.

* cited by examiner

*Primary Examiner* — Anastasia Midkiff
(74) *Attorney, Agent, or Firm* — Muncy, Geissler, Olds & Lowe, PLLC

(57) ABSTRACT

A betatron is provided for producing pulses of accelerated electrons, particularly in an x-ray testing device, comprising at least one main field coil, one expansion coil for transferring the accelerated electrons to a target, and one electronic control system of the expansion coil for applying an expansion pulse to the expansion coil. The electronic control system of the expansion coil is designed such that the time of the expansion pulse for adjusting the final energy of the electrons is variable relative to the main field.

11 Claims, 4 Drawing Sheets

CIRCULAR ACCELERATOR WITH ADJUSTABLE ELECTRON FINAL ENERGY

This nonprovisional application is a continuation of International Application No. PCT/EP2007/007767, which was filed on Sep. 6, 2007, and which claims priority to German Patent Application No. 102006056018.3, which was filed in Germany on Nov. 28, 2006, and which are both herein incorporated by reference.

BACKGROUND OF THE INVENTION

1. Field of the Invention

The present invention concerns a betatron for producing pulses of accelerated electrons, in particular in an X-ray inspection device.

2. Description of the Background Art

The use of X-ray inspection devices such as the one illustrated in FIG. 4 is known for screening articles of large volume such as cargo containers and vehicles for prohibited contents such as weapons, explosives or smuggled goods. Here, X-rays are generated and directed at the article (e.g., target 50). The X-rays attenuated by the article are measured by means of a detector (e.g., x-ray detector 52) and are analyzed by an analysis unit (e.g., analysis unit 54). This makes it possible to draw conclusions about the nature of the article. Such an X-ray inspection device is known from European patent EP 0 412 190 B1, for example. To better distinguish different materials, it is advantageous to successively inspect the article with X-rays of different energies.

Betatrons are used to generate the X-rays with energies greater than 1 MeV that are required for the inspection. These are circular accelerators in which electrons are injected into an evacuated betatron tube and are accelerated around a circular path by an increasing magnetic field generated by a primary field coil. The accelerated electrons are steered onto a target where they generate "bremsstrahlung" radiation, the spectrum of which depends on factors that include the energy of the electrons. The acceleration of the electrons is repeated in a cyclic manner, resulting in pulsed X-rays.

The electrons are injected into the betatron tube, for example by an electron gun, and the current through the primary field coil, and thus the strength of the magnetic field, is increased. The changing magnetic field generates an electric field that accelerates the electrons around their circular path with radius $r_s$. At the same time, the Lorentz force on the electrons increases with the magnetic field strength. This keeps the electrons at an essentially constant path radius. An electron moves in a circular path when the Lorentz force in the direction of the center point of the circular path and the centripetal force in the opposite direction cancel one another out. From this comes the Wideröe condition $$\frac{1}{2}\frac{d}{dt}\langle B(r_s)\rangle = \frac{d}{dt}B(r_s)$$

where $$\langle B(r_s)\rangle = \frac{1}{\pi \cdot r_s^2}\int\int_A B(r)\,dA$$

Accordingly, $\langle B(r_s)\rangle$ is the averaged magnetic flux through the circular area of radius $r_s$, and $B(r_s)$ is the magnetic flux at this normal path radius $r_s$.

SUMMARY OF THE INVENTION

In order to improve the detection result, it is desirable to penetrate the object under test with X-rays having different energies. It is therefore an object of the present invention to provide a betatron for producing pulses of accelerated electrons in which the final energy of the accelerated electrons is adjustable.

An betatron according to an embodiment can include at least of a primary field coil, an expansion coil for transferring the accelerated electrons onto a target, and an electronic control system for the expansion coil for applying an expansion pulse to the expansion coil. In this regard, the electronic control system for the expansion coil is designed such that the time of the expansion pulse relative to the primary field is variable in order to set the final energy of the electrons. This means that the time of turn-on of the expansion pulse can be shifted in time in relation to the current pulse through the primary coil(s). This variability of the expansion pulse makes it possible to exactly determine the time at which the electrons are steered onto the target. This simultaneously determines how much energy the primary field has delivered to the electrons between their injection into the betatron tube and their transfer. This is equivalent to setting the maximum energy of the X-rays that the electrons generate when striking the target.

In an embodiment of the invention, the time of the expansion pulse relative to the primary field is variable from pulse to pulse. This means that in each acceleration cycle the final energy of the electrons can be set independently of the preceding acceleration cycles. This results in the advantage that two measurements of an object can be performed with different radiation energies in a short period of time in an X-ray inspection device with an inventive betatron.

The free selectability of the time of the expansion pulse is preferably achieved by the means that the electronic control system for the expansion coil has a semiconductor switch that can be switched off, in particular an IGBT (Insulated Gate Bipolar Transistor) or a MOSFET (Metal Oxide Semiconductor Field Effect Transistor). Such switches can rapidly switch even large currents on and/or off at arbitrary points in time as a function of a control pulse.

In an advantageous manner, the expansion coil is connected through the semiconductor switch to an independent energy source, such as a current or voltage source, to form a circuit. A voltage source can also be a capacitor or capacitor bank, for example. If the semiconductor switch is closed, the energy source causes a current to flow through the expansion coil. During this current flow, which is the expansion pulse, the electrons are deflected from their normal path onto the target. The term "independent" means that the energy source is decoupled as much as possible from other energy sources, such as those for the primary field coils. This results in a more stable energy supply for the expansion coil and thus a more precisely controllable expansion pulse.

An inventive betatron preferably has a drive circuit for the primary field coil that is designed such that the current through the primary field coil can be switched on and off at any desired points in time. This makes it possible for the current through the primary field coil to be switched off, at the latest, when all electrons have arrived at the target, for example. This avoids having the primary field coil absorbing energy even when there are no more electrons left in the betatron coil, thus also minimizing the power dissipation of the betatron. Furthermore, this makes it possible to vary the repetition frequency of the pulses of electrons and thus of the pulses of X-rays.

A drive circuit for a primary field coil in a betatron has an energy storage device, two power switches and two diodes, for example. In this regard, an embodiment includes a first terminal of the first power switch is connected to a first terminal of the energy storage device, a second terminal of the first power switch is connected to a first terminal of the first diode, a second terminal of the first diode is connected to a second terminal of the energy storage device, a first terminal of the second diode is connected to the first terminal of the energy storage device, a second terminal of the second diode is connected to a first terminal of the second power switch, a second terminal of the second power switch is connected to the second terminal of the energy storage device, a first terminal of the primary field coil is connected to the second terminal of the first power switch, a second terminal of the primary field coil is connected to the second terminal of the second diode, and the control terminals of the power switches are connected to an electronic control system.

The drive circuit here corresponds to a half bridge having a first branch with a first power switch and a first diode, and a second branch in parallel therewith a second diode and a second power switch. The primary field coil forms the bridge between the two branches. The ends of the two branches are connected to the terminals of an energy storage device.

The terminals of the energy storage device are preferably connected to a voltage source. The voltage source recharges the energy storage device and supplies the drive circuit with the power required for accelerating the electrons. With the inventive drive circuit, the voltage source can be continuously connected to the energy storage device, since the energy storage device is operated with unchanging polarity.

In an advantageous manner, the power switches are power semiconductors that can be switched off, such as IGBTs (Insulated Gate Bipolar Transistor) or MOSFETs (Metal Oxide Semiconductor Field Effect Transistor). In contrast to, e.g., thyristors, such switches can be turned off at any desired points in time without complicated circuitry. This achieves fast switching times, which allow a precisely controlled current flow time through the primary field coil.

The energy storage device is preferably a bipolar capacitor such as a film capacitor. Such capacitors exhibit high load current capacity and long life.

The betatron can be used in an X-ray inspection device for security screening of articles. Electrons are injected into the betatron and are accelerated before they are steered onto a target, for example made of tantalum. The electrons generate X-rays there which have a known spectrum. The X-rays are directed at the article, preferably a cargo container and/or a vehicle, and are modified there, for example by scattering or transmission attenuation. The modified X-rays are measured by an X-ray detector and are analyzed by means of an analysis unit. Conclusions are drawn concerning the nature or contents of the article on the basis of the results.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
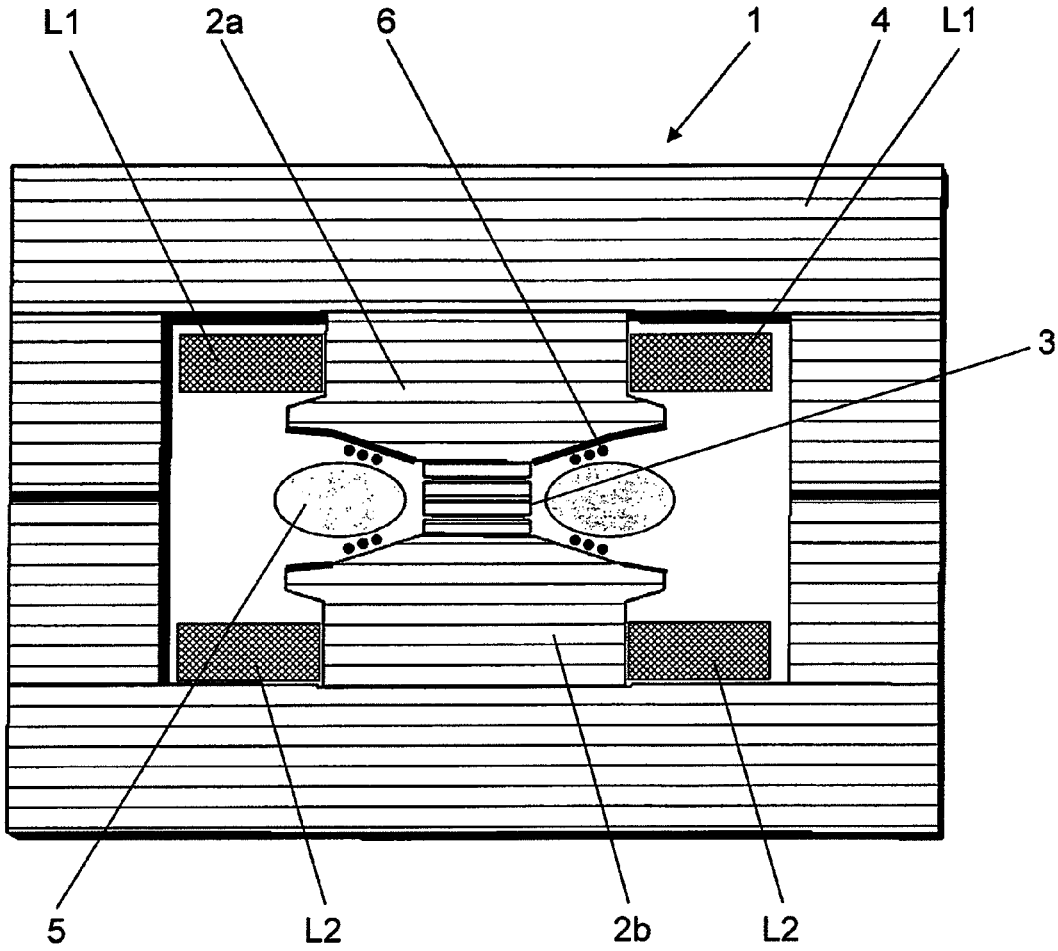
FIG. 1 shows a schematic sectional representation of a betatron.

FIG. 1 shows the schematic structure of a betatron 1 in cross-section. It includes a rotationally symmetric inner yoke including two parts 2*a*, 2*b*, spaced apart from one another, four circular plates 3 between the inner yoke parts 2*a*, 2*b*, wherein the longitudinal axis of the circular plates 3 coincides with the axis of rotational symmetry of the inner yoke, an outer yoke 4 connecting the two inner yoke parts 2*a*, 2*b*, a toroidal betatron tube 5 located between the inner yoke parts 2*a*, 2*b*, two primary field coils L1 and L2, and an expansion coil 6. The expansion coil 6 includes two coil sections electrically connected in series and grouped in a Helmholtz configuration, each located in the vicinity of the end faces of the inner yoke parts 2*a* and 2*b*. The two primary field coils L1 and L2 are also electrically connected in series.

The center axis of the expansion coil 6 coincides with the axis of rotational symmetry of the inner yoke. As a result of this arrangement and the size of the expansion coil 6, the magnetic field it generates passes through a circular area whose radius is larger than the radius of the circular plates 3 and lies approximately in the area of the normal path radius $r_s$ of the electrons.

The magnetic field generated by the primary field coils L1 and L2 passes through the inner yoke parts 2*a* and 2*b*, wherein the magnetic circuit is closed by the outer yoke 4. The shapes of the inner and/or outer yoke can be chosen by the practitioner of the art as a function of the application, and may differ from the shape shown in FIG. 1. Also, only one, or more than two, primary field coils may be present. A different number and/or shape of the circular plates 3 is also possible.

Between the end faces of the inner yoke parts 2*a* and 2*b*, some of the magnetic field passes through the circular plates 3, and the rest passes through an air gap. Located in this air gap is the betatron tube 5; this is an evacuated tube in which the electrons are accelerated. The end faces of the inner yoke parts 2*a* and 2*b* have a shape that is chosen such that the magnetic field between them focuses the electrons into a circular path. The design of the end faces is known to practitioners of the art and is therefore not described in detail. At the end of the acceleration process, the electrons strike a target and thereby generate X-rays, the spectrum of which depends on factors that include the final energy of the electrons and the material of the target.

For purposes of acceleration, the electrons are injected into the betatron tube 5 with an initial energy. During the acceleration phase, the magnetic field in the betatron 1 is progressively increased by the primary field coils L1 and L2. This generates an electric field that exerts an accelerating force on the electrons. At the same time, the electrons are forced onto a normal circular path inside the betatron tube 5 as a result of the Lorentz force.

The acceleration of the electrons is cyclically repeated, resulting in pulsed X-rays. In each cycle, the electrons are injected into the betatron tube 5 in a first step. In a second step, the electrons are accelerated in the circumferential direction of their circular path by an increasing current in the primary field coils L1 and L2, and thus by an increasing magnetic field in the air gap between the inner yoke parts 2*a* and 2*b*. In a third step, an expansion pulse is applied to the expansion coil, by which means the Wideröe condition is changed and the accelerated electrons are transferred onto the target to generate the X-rays. There follows an optional pause before electrons are again injected into the betatron tube 5.

Figure 2:
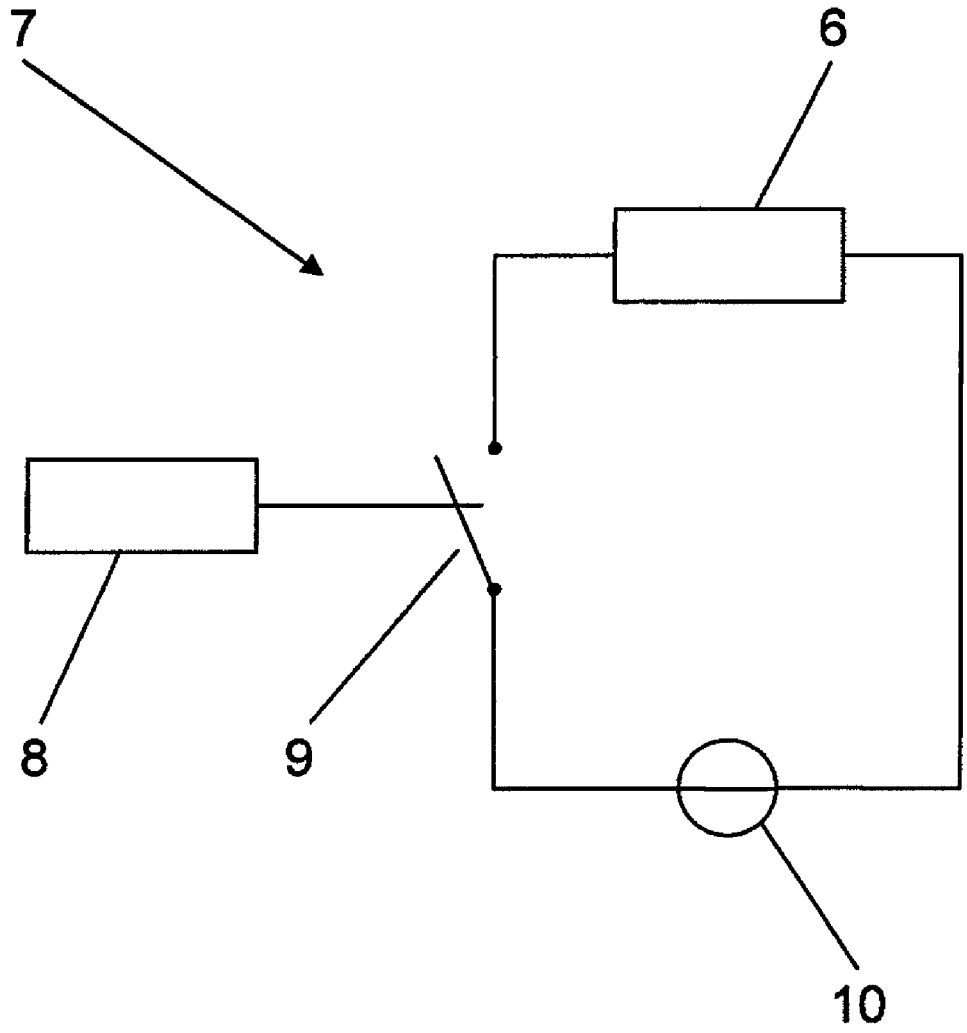
FIG. 2 shows a drive circuit for an expansion coil.

FIG. 2 shows a schematic and considerably simplified view of a drive circuit 7 for the expansion coil 6. The expansion coil 6 is connected to a voltage source 10 through an IGBT 9 that can be driven by an electronic control unit 8. The points in time when the IGBT is switched are arbitrary and depend solely on the control signals from the electronic control unit 8, so that the time of the expansion pulse relative to the current flow through the primary field coils L1 and L2 is freely selectable. In this way, the duration of acceleration and thus the final energy of the electrons in each pulse can be set.

Figure 3:
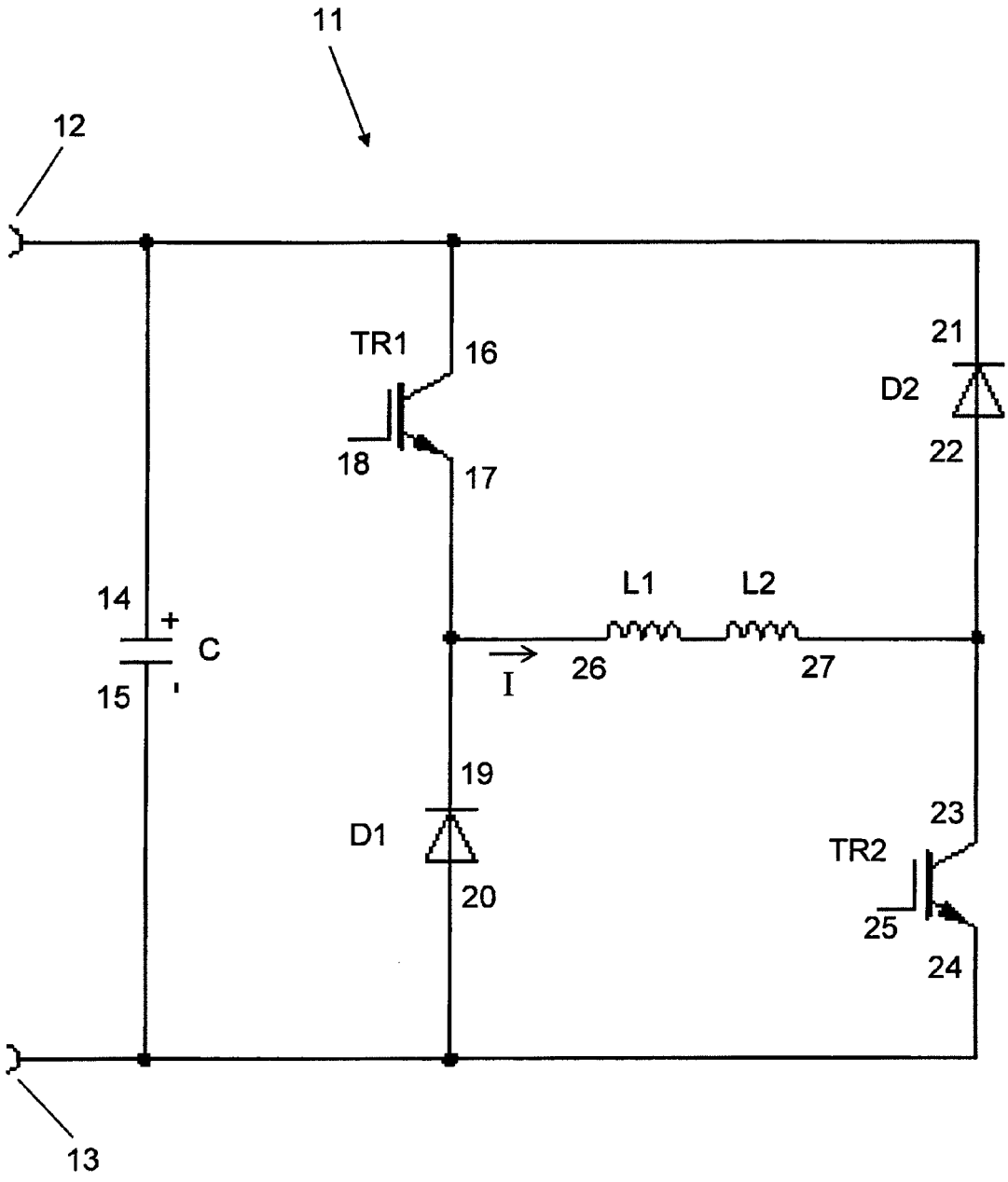
FIG. 3 shows a drive circuit for two primary field coils.
Figure 4:
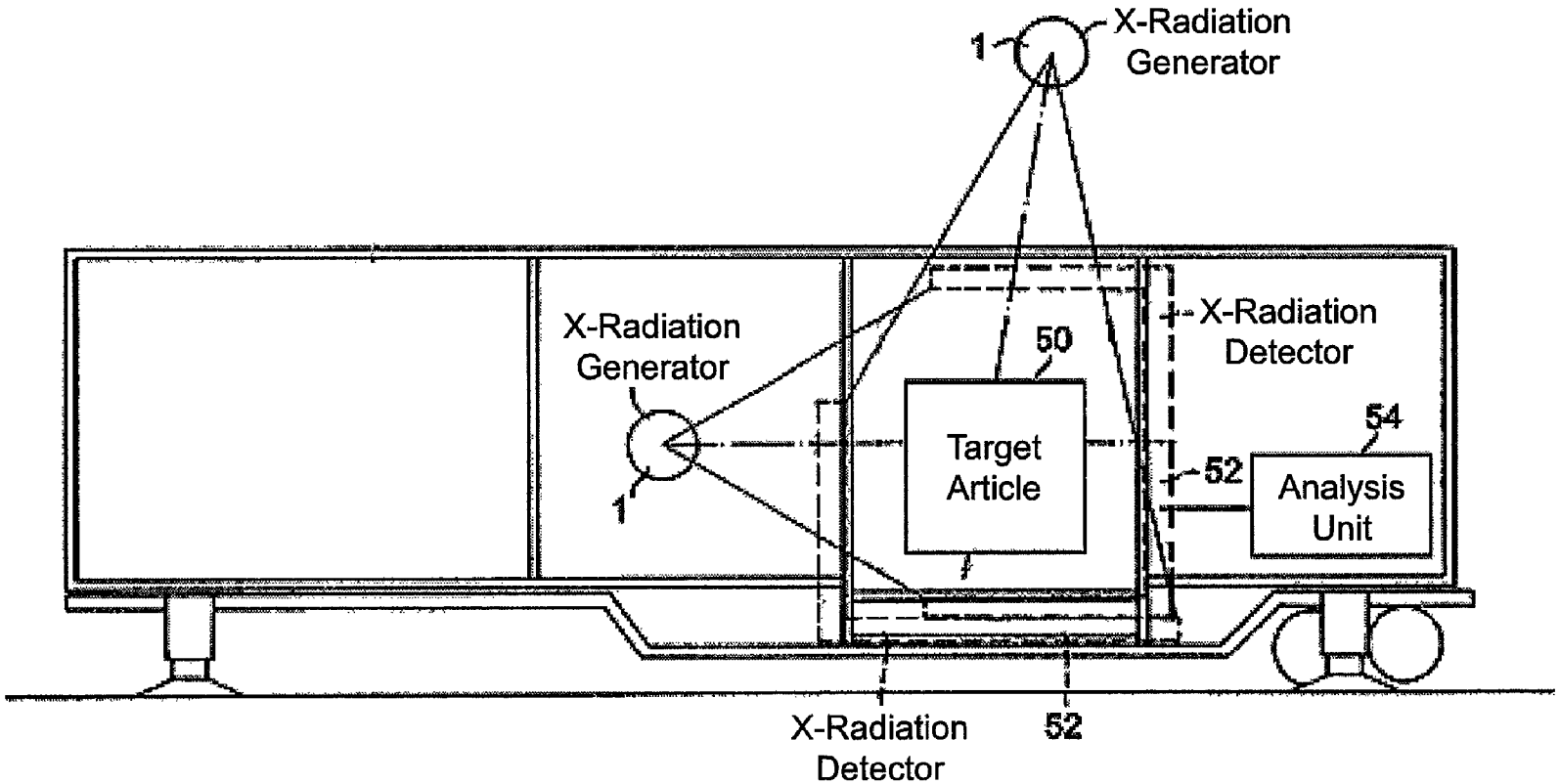
Fig. 4 (Conventional Art)
FIG. 4 shows a conventional x-ray inspection system for security inspection of objects.

FIG. 3 shows a drive circuit 11 for the series-connected primary field coils L1 and L2. The circuit includes a capacitor C, two IGBTs TR1 and TR2, and two diodes D1 and D2. The first IGBT TR1 and the first diode D1 are connected in series such that a first terminal 14 of the capacitor C is connected to the collector 16 of the first IGBT TR1, the emitter 17 of the first IGBT TR1 is connected to the cathode 19 of the first diode D1, and the anode 20 of the first diode D1 is connected to a second terminal 15 of the capacitor C. The second IGBT TR2 and the second diode D2 are connected in series such that the cathode 21 of the second diode D2 is connected to the first terminal 14 of the capacitor C, the anode 22 of the second diode D2 is connected to the collector 23 of the second IGBT TR2, and the emitter 24 of the second IGBT TR2 is connected to the second terminal 15 of the capacitor C.

The base terminals 18 and 25 of the IGBTs TR1 and TR2 are connected to the electronic control unit 8. One terminal 26 of the primary field coil L1 is connected to the emitter 17 of the first IGBT TR1, and one terminal 27 of the primary field coil L2 is connected to the collector 23 of the second IGBT TR2. The capacitor C, and thus the drive circuit 11, is optionally connected to a voltage source through the terminals 12 and 13.

The structure of the drive circuit 7 for the expansion coil 6 corresponds to that of the drive circuit 11 for the primary field coils L1 and L2 from FIG. 3.

At the start of an acceleration cycle, electrons are injected into the betatron tube 5, and the electronic control unit 8 drives the IGBTs TR1 and TR2 such that they turn on. As a result, an increasing current I flows in the direction indicated in FIG. 3 from the capacitor C through the two IGBTs TR1 and TR2 and through the primary field coils L1 and L2. In this process, energy is transferred from the capacitor C to the primary field coils L1 and L2, and the electrons are accelerated in the betatron tube 5.

At a time that depends on the desired final energy of the electrons, the electronic control unit 8 turns on the IGBT 9 of the drive circuit 7 of the expansion coil 6, thus starting the expansion pulse. By this means, the electrons are diverted from the normal path and steered onto a target. Once all electrons are transferred, the expansion pulse ends.

As soon as the electronic control unit 8 places the IGBTs TR1 and TR2 in a non-conducting state, the magnetic field generated by the primary field coils L1 and L2 decays. The decaying magnetic field generates a current flow I with decreasing current magnitude through the diodes D1 and D2 to the capacitor C until the energy stored in the primary field coils L1 and L2 has flowed back into the capacitor C. The direction of current through the primary field coils L1 and L2 is the same as during the buildup of the magnetic field, but is reversed through the capacitor C.

At the start of the following acceleration cycle, electrons are again injected into the betatron tube 5, and the IGBTs TR1 and TR2 are turned on. If the final energy is to be, e.g., smaller than in the preceding cycle, the IGBTs 9 of the drive circuit 7 of the expansion coil 6 are driven sooner by the electronic control system 8. This results in an earlier transfer of the electrons to the target. The electrons here have taken on less energy than in the preceding acceleration cycle, for which reason the maximum energy of the X-rays generated is also lower.

As a result of the earlier expansion pulse, the current flow I from the capacitor C into the primary field coils L1 and L2 can be terminated sooner as well. The energy consumption of the betatron 1 and the dissipated heat to be removed are reduced as a result of this prompt shutoff of the current flow.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A betatron for producing pulses of accelerated electrons in an X-ray inspection device, the betatron comprising:

at least one primary field coil;

an expansion coil for transferring the accelerated electrons onto a target; and an electronic control system for the expansion coil configured to apply an expansion pulse to the expansion coil, the electronic control system for the expansion coil configured such that the time of the expansion pulse relative to the primary field is variable in order to set a final energy of the electrons.

2. The betatron according to claim 1, wherein the time of the expansion pulse relative to the primary field is variable from pulse to pulse.

3. The betatron according to claim 1, wherein the electronic control system for the expansion coil has a semiconductor switch that can be switched off, in particular an IGBT (Insulated Gate Bipolar Transistor).

4. The betatron according to claim 3, wherein the expansion coil is connectable through the semiconductor switch to an independent energy source to form a circuit.

5. The betatron according to claim 1, further comprising a drive circuit for the primary field coil that is configured such that the current through the primary field coil is switched on and off at any desired points in time.

6. The betatron according to claim 5, wherein the drive circuit for the primary field coil has an energy storage device, two power switches, and two diodes, wherein a first terminal of the first power switch is connected to a first terminal of the energy storage device, wherein a second terminal of the first power switch is connected to a first terminal of the first diode, wherein a second terminal of the first diode is connected to a second terminal of the energy storage device, wherein a first terminal of the second diode is connected to the first terminal of the energy storage device, wherein a second terminal of the second diode is connected to a first terminal of the second power switch, wherein a second terminal of the second power switch is connected to the second terminal of the energy storage device, wherein a first terminal of the primary field coil is connected to the second terminal of the first power switch, wherein a second terminal of the primary field coil is connected to the second terminal of the second diode, and wherein the control terminals of the power switches are connected to an electronic control system.

7. The betatron according to claim 6, wherein the terminals of the energy storage device in the drive circuit for the primary field coil are connected to a voltage source.

8. The betatron according to claim 6, wherein the power switches in the drive circuit for the primary field coil are semiconductor switches that can be switched off, in particular IGBTs (Insulated Gate Bipolar Transistors).

9. The betatron according to claim 8, wherein the energy storage device in the drive circuit for the primary field coil is a bipolar capacitor.

10. An X-ray inspection device for security screening of articles, the device comprising:

a target for generation of X-rays;

an X-ray detector;

an analysis unit; and a betatron comprising:

at least one primary field coil;

an expansion coil for transferring the accelerated electrons onto a target; and an electronic control system for the expansion coil configured to apply an expansion pulse to the expansion coil, the electronic control system for the expansion coil configured such that the time of the expansion pulse relative to the primary field is variable in order to set a final energy of the electrons.

11. The betatron according to claim 9, wherein the bipolar capacitor is a film capacitor.

* * * * *